United States Patent [19]

Alvarez

[11] Patent Number: 5,029,783

[45] Date of Patent: Jul. 9, 1991

[54] FLEXIBLE MAILBOX STAND

[76] Inventor: Aroldo Alvarez, 9134 SW. 21 Ter., Miami, Fla. 33165

[21] Appl. No.: 601,621

[22] Filed: Oct. 23, 1990

[51] Int. Cl.[5] ..... F16M 13/00

[52] U.S. Cl. ..... 248/146; 40/608; 232/39; 248/160

[58] Field of Search ..... 248/146, 160; 404/10; 232/17, 39; 40/602, 608

[56] References Cited

U.S. PATENT DOCUMENTS

| | | | |
|---|---|---|---|
| 1,313,616 | 8/1919 | Walsh | 40/608 |
| 1,341,318 | 5/1920 | Hannagan | 248/160 |
| 1,679,623 | 8/1928 | Olsen | 40/608 |
| 1,726,817 | 9/1929 | Franklin | 40/608 |
| 2,009,040 | 7/1935 | Beach | 248/160 |
| 2,094,475 | 9/1937 | Schwarzhaupt | 248/160 X |
| 2,103,410 | 12/1937 | Frei, Jr. | 248/160 X |
| 2,165,704 | 7/1939 | Hood | 40/608 |
| 2,949,324 | 8/1960 | Birge et al. | 40/608 X |
| 4,270,873 | 6/1981 | Laehy et al. | 404/10 |
| 4,373,464 | 2/1983 | Blau | 404/10 X |
| 4,636,109 | 1/1987 | Clausen et al. | 404/10 |
| 4,792,088 | 12/1988 | Bonnell | 248/160 X |

FOREIGN PATENT DOCUMENTS

| | | | |
|---|---|---|---|
| 234785 | 7/1961 | Australia | 40/608 |
| 1540430 | 8/1968 | France | 404/10 |
| 2408706 | 7/1979 | France | 404/10 |

*Primary Examiner*—David L. Talbott
*Attorney, Agent, or Firm*—J. Sanchelima

[57] ABSTRACT

A stand for mailboxes provides an elongated structural assembly that includes an upper section that is rigidly mounted to a mailbox and a lower section that is rigidly mounted to a fixed location. The two sections are coaxially aligned next to each other and urged towards each other through the action of a spring member that is pre-stretched inside the inner and lower sections. The larger the deflection of the upper section with respect to the at rest coaxial alignment with the lower section, the larger the recovering force that is created perpendicular to the at rest coaxial alignment.

5 Claims, 2 Drawing Sheets

FLEXIBLE MAILBOX STAND

BACKGROUND OF THE INVENTION

1. Field of the Invention

The present invention relates to mailbox stands, and more particularly, to such stands that include a movable structural member.

2. Description of the Related Art

Applicant believes that the closest reference corresponds to U.S. Pat. No. 4,792,088 issued to Bonnell. However, it differs from the present invention because the spring used to provide the moving or pivoting characteristic would not efficiently recover its position when the mailbox is loaded with considerable weight. If a stronger spring is used, then the stand will not avoid the damaging effect of the impact since it will oppose the impact. This reference does not teach pre-stressing the spring in order to insure that the structure recovers its original upright position.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a mailbox stand that readily deflects from its upright alignment and recovers when the deflecting force ceases.

It is another object of this present invention to provide a mailbox stand that absorbs the impact with a minimum damage.

It is yet another object of this present invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
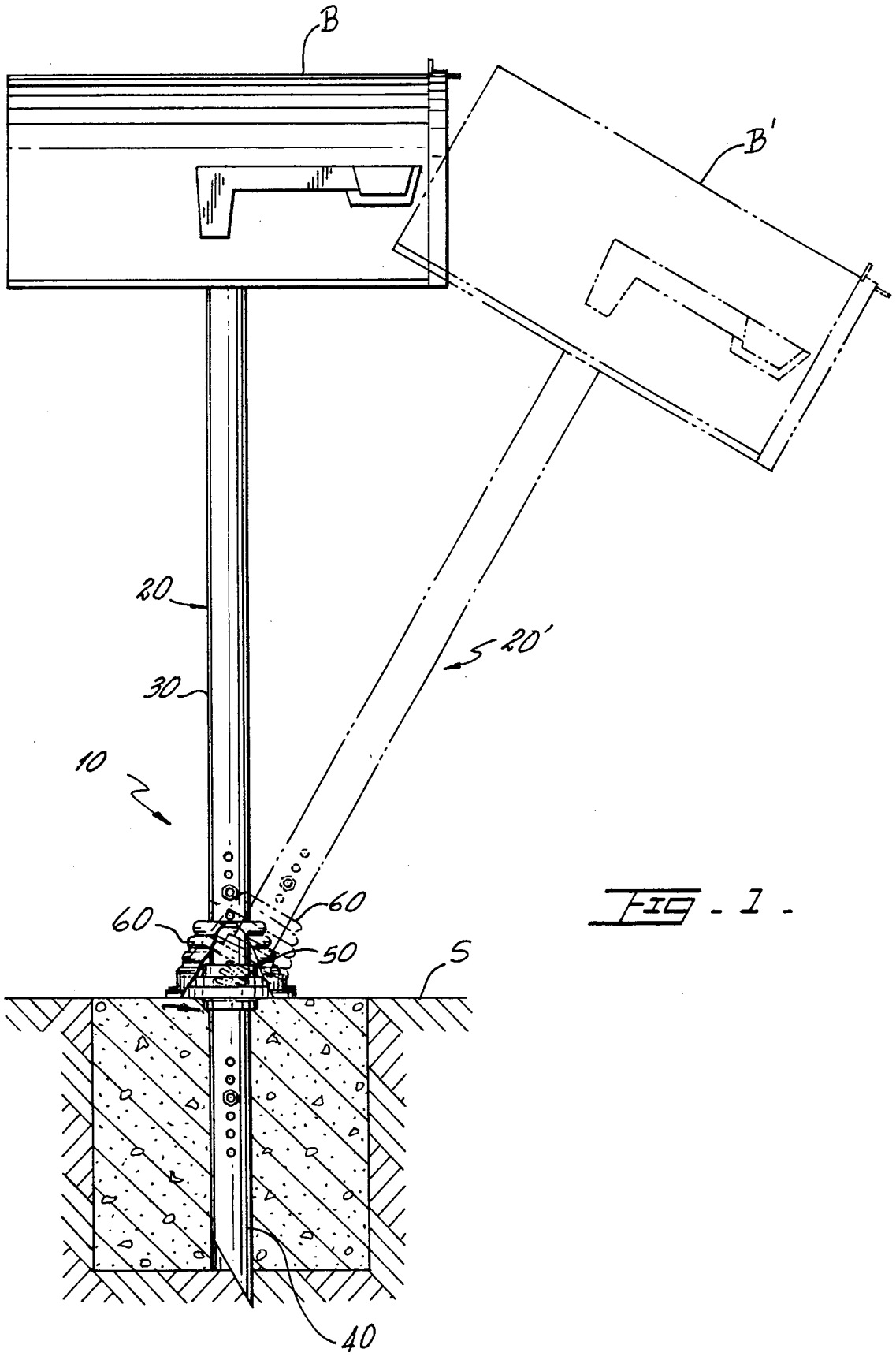
FIG. 1 represents a side elevational view of the present invention holding a mailbox, with the phantom illustration showing the deflection of the structure.

Referring now to FIG. 1, where the present invention is generally referred to with numeral 10, it can be observed that it basically includes a tubular elongated structural assembly 20 with a mailbox B mounted on its upper end and the lower end being rigidly mounted to concrete slab S in one of the preferred embodiments. Tubular elongated structural assembly 20' is showing in phantom in FIG. 1 showing how it can be deflected through the application of force. After the force ceases, assembly 20' recovers its upright orientation. Assembly 20 comprises of two sections: upper section 30 and lower section 40 with an internal spring member 50 bringing them towards each other. These two sections are abuttingly and coaxially positioned with respect to each other. Rubber cover 60 is designed to protect the interface between upper section 30 and lower section 40 from dust and dirt. Preferably, upper section 30 starts substantially at ground level and extends upwardly to a suitable distance where mailbox B is mounted to permit the ready withdrawal of mail.

Figure 2:
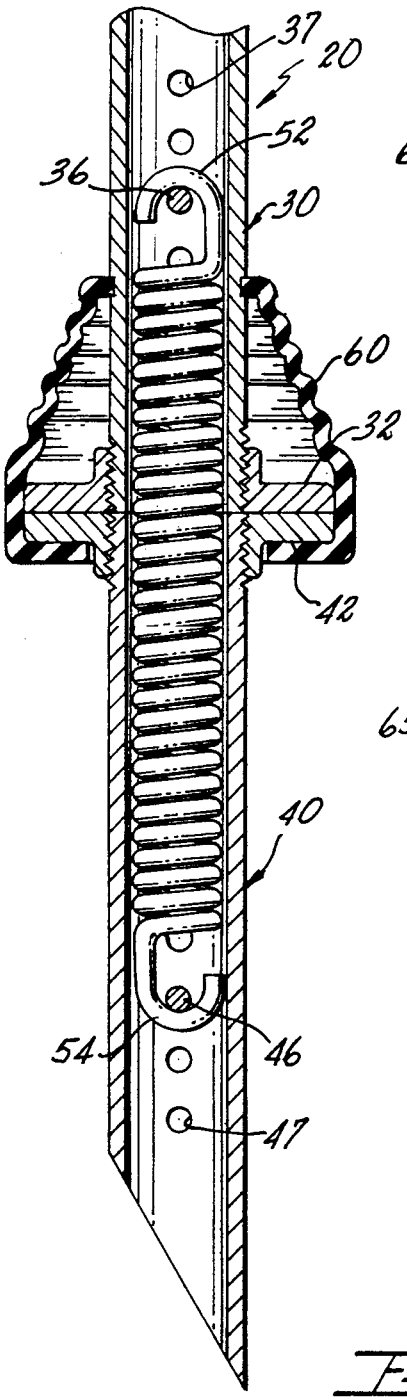
FIG. 2 shows a partial cross-sectional view of the tubular elongated structural member showing the prestressed internal spring.

In FIG. 2, a detailed cross-sectional view of the abutting section is shown. The lower end of upper section 30 is threaded and receives threaded flanged ring 32 that comes in contact with similar threaded flanged ring 42. Rubber cover 60 covers threaded flanged ring 32 completely and part of threaded flanged ring 42. In this manner, more structural stability is introduced to tubular elongated structural assembly 20.

Spring member 50 is housed within tubular elongated structural assembly 20 and it is pre-stressed sufficiently to exert and effective amount of force that urges upper section 30 towards section 40. In this manner, upper section 30 recovers its coaxially disposed position with respect to section 40 which in the preferred embodiment extends upwardly. Different degrees of pretensioning can be achieved by hooking ends 52 and 54 of spring 50 to internal pins 36 and 46 that are transversally disposed inside tubular section 30 and 40, respectively, and are removably inserted through openings 37 and 47. When upper section 20 is deflected, the horizontal component of the spring contraction force is approximately the spring contraction force multiplied by the sine of the angle of deflection. The larger the deflection angle, the larger the horizontal force component that will urge upper section to recover its coaxial alignment with lower section 40. It is important to note that the recovery force is composed of the torsional recovery force plus the horizontal component of the pre-tensioning force. The horizontal component of the pre-tensioning force is approximately the sine of the angle (A) multiplied by the pre-tensioning force magnitude.

Figure 4:
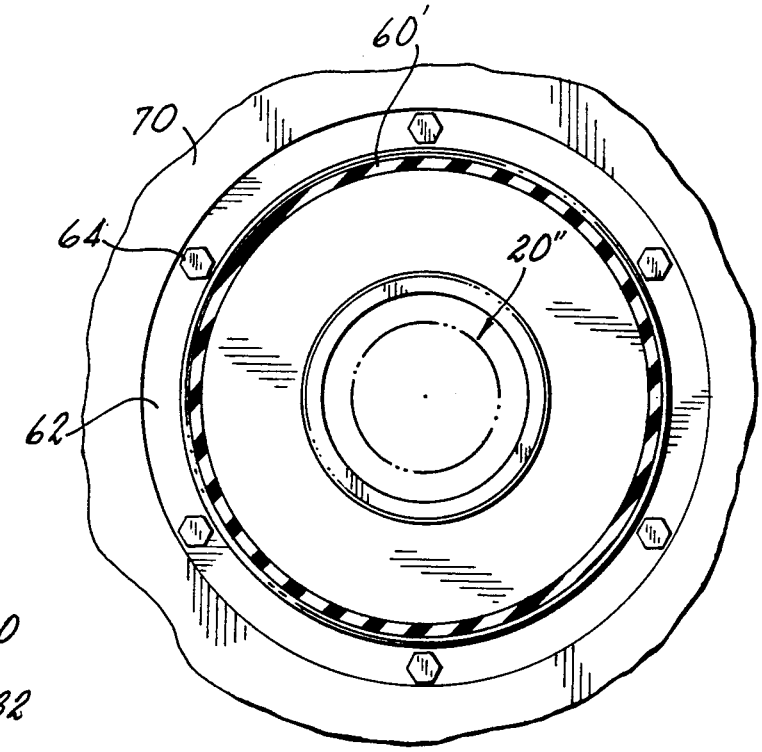
FIG. 4 is a representation of a top view of the illustration shown in FIG. 3.
Figure 3:
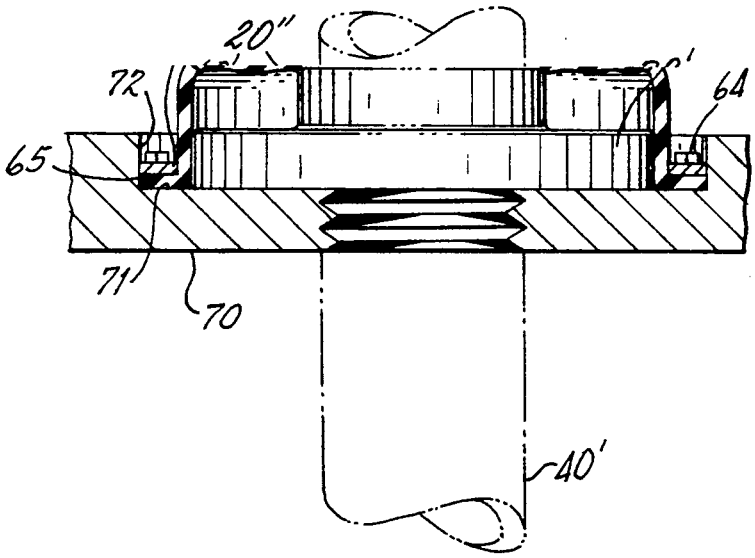
FIG. 3 illustrates a section of an alternate embodiment showing the invention mounted to a platform.

In FIGS. 3 and 4 and alternate embodiment for mounting tubular elongated structural assembly 20 showing in phantom is illustrated it basically consists of using a platform member 70 for users that do not desire to pour a slab. Platform member 70, in the alternate embodiment, fulfills the function of lower flanged ring 42. Recess 72 is preferably sufficiently deep to receive lower flanged ring 32'. Rubber cover 60' covers upper flanged rings 32', and in the preferred alternate embodiment, cover 60' includes a flanged termination 65 that rests against surface 71 of platform member 70. Bolt members 64 keep flanged termination 65 in place, preferably using circular plate 62 with through openings, thereby preventing the entry of any dirt or foreign bodies between the abutting surfaces of flanged rings 32' and 42'.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense.

What is claimed is:

1. A stand for mailboxes mounted to a concrete slab comprising a tubular elongated structural member having an upper section and a lower section, and said sections being coaxially aligned and each having two ends and wherein one of the ends of said upper section is rigidly mounted to said mailbox and one of the ends of said lower section being rigidly mounted to said concrete slab, and the other ends of said upper and lower sections being disposed next to each other and said other ends of said upper and lower sections being disposed next to each other and each one including one flanged ring member rigidly mounted on each of said other ends so that substantial cooperative surfaces from each of said flanged ring members abutting to each other provide substantially structural stability to the stand and further including spring means for urging said upper and lower sections toward each other and said spring means being in a pre-stretched condition and wherein said spring means are internally disposed within said lower and upper sections such that a torsional recovery force and a horizontal component of the spring contraction force acts on the upper section and further including rubber cover means for preventing extraneous bodies from penetrating between said upper and lower sections.

2. The stand set forth in claim 1 further including means for adjusting the pre-stretched condition of said spring means.

3. A stand for mailboxes mounted to a platform member comprising a tubular elongated structural member having an upper section and a lower section, and said sections being coaxially aligned and each having two ends and wherein one of the ends of said upper section is rigidly mounted to said mailbox and one of the ends of said lower section being rigidly mounted to a fixed point in said platform, and the other end of said upper section being disposed next to one of the ends of said lower section having a threaded termination that is cooperatively received through a threaded portion in said platform member and wherein said ends of said upper and lower section being disposed next to each other include, each, one flanged ring member rigidly mounted on each of said other ends so that substantial cooperative surfaces from each of said flanged ring members abutting to each other provide substantially structural stability to the stand and further including spring means for urging said upper and lower sections toward each other and said spring means being a pre-stretched condition and wherein said spring means are internally disposed within said lower and upper sections such that a torsional recovery force and a horizontal component of the spring contraction force acts on the upper section and further including rubber cover means for preventing extraneous bodies from penetrating between said upper and lower sections.

4. The stand set forth in claim 3 wherein said platform includes a sufficiently large recess to house said flanged ring member.

5. The stand set forth in claim 3 wherein said rubber cover means includes a peripheral outwardly extending flanged termination and fastening means for keeping said cover means rigidly in place with respect to said recess.

* * * * *